US009611095B2

(12) United States Patent
Huff

(10) Patent No.: US 9,611,095 B2
(45) Date of Patent: Apr. 4, 2017

(54) PIVOTAL THRESHOLD AND ATTACHMENT TO REFUSE CONTAINER

(71) Applicant: Charles Adrian Huff, Mountain View, CA (US)

(72) Inventor: Charles Adrian Huff, Mountain View, CA (US)

( * ) Notice: Subject to any disclaimer, the term of this patent is extended or adjusted under 35 U.S.C. 154(b) by 0 days.

(21) Appl. No.: 14/158,328

(22) Filed: Jan. 17, 2014

(65) Prior Publication Data

US 2015/0203292 A1 Jul. 23, 2015

(51) Int. Cl.
*B65F 1/14* (2006.01)
*B65B 67/12* (2006.01)
*B65F 1/10* (2006.01)

(52) U.S. Cl.
CPC ..... *B65F 1/14* (2013.01); *B65B 67/12* (2013.01); *B65F 1/10* (2013.01)

(58) Field of Classification Search
CPC ..... B65F 1/14; B65F 1/002; B65F 1/1421; B65F 1/10; B65B 67/12
USPC ... 220/86.1, 694, 908.3, 212, 817, 818, 819, 220/814; 15/257.1; 141/390, 108, 114, 141/316; 248/101, 99; 126/194; 383/33.8
See application file for complete search history.

(56) References Cited

U.S. PATENT DOCUMENTS

| | | | | |
|---|---|---|---|---|
| 3,390,804 | A * | 7/1968 | Morgan | 220/212 |
| 4,907,710 | A * | 3/1990 | Bulkens | 220/495.1 |
| 5,085,342 | A * | 2/1992 | Strawder | B65F 1/06 220/495.09 |
| 5,222,536 | A * | 6/1993 | Hodgdon et al. | 141/390 |
| 5,511,807 | A * | 4/1996 | Snyder | 280/47.26 |
| 6,915,921 | B2 * | 7/2005 | Mensch | 220/212 |
| 6,974,167 | B2 * | 12/2005 | Springs, II | 294/214 |
| D668,417 | S * | 10/2012 | Thomas et al. | D34/10 |
| 2003/0214141 | A1 * | 11/2003 | Morris | A47L 13/52 294/176 |
| 2008/0078374 | A1 * | 4/2008 | Polkinghorn et al. | 126/194 |

* cited by examiner

*Primary Examiner* — J. Gregory Pickett
*Assistant Examiner* — Don M Anderson

(57) ABSTRACT

The invention is a convenient ramp-like pivotal threshold attached to a refuse container that is laid over on one side, over which to sweep debris on a floor or ground surface directly into the open end of the container. This invented threshold attachment allows the ramp threshold to be pivoted from a stored, out of the way, on the outside wall of a conventionally used refuse container standing in a vertical position, to an operating deployed position on the refuse container, laid horizontally on one side. This pivotal threshold can be removably or permanently attached to the reinforced rolled edge of the open end of a rectangular solid refuse container or to an axle that is removably or permanently attached to the curved rolled edge of the open end of a cylindrical refuse container.

2 Claims, 2 Drawing Sheets

FIG. 1
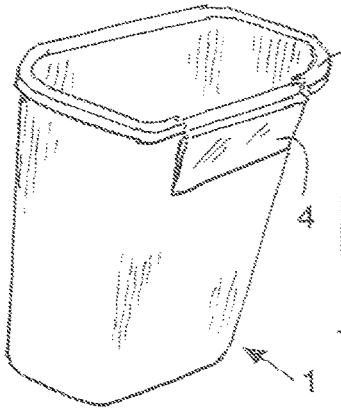
FIG. 2
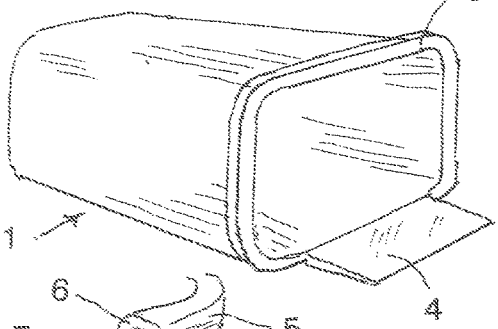
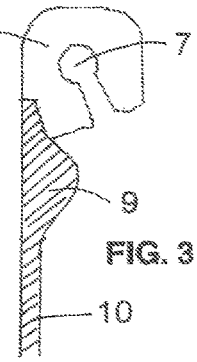
FIG. 3
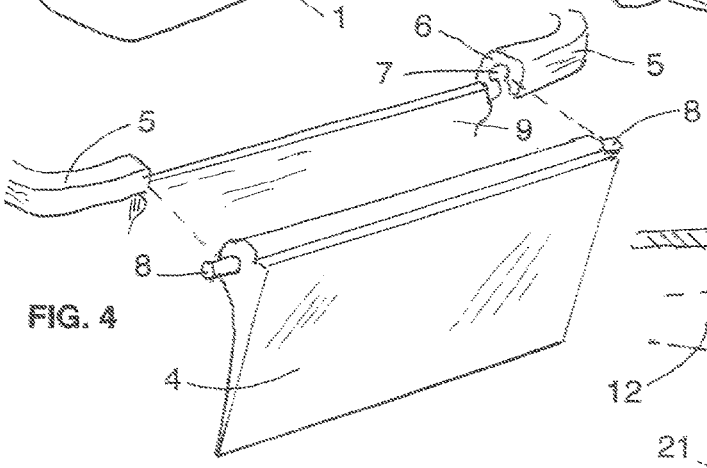
FIG. 4
FIG. 5
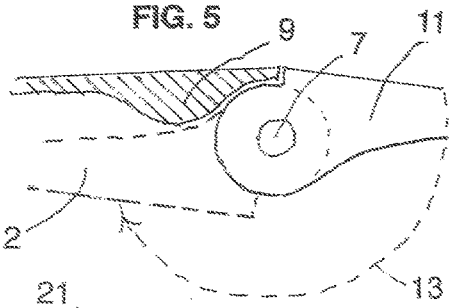
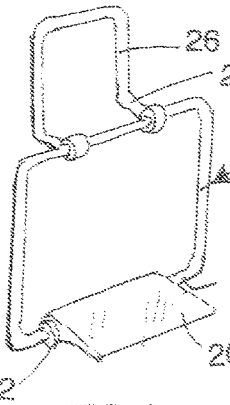
FIG. 6
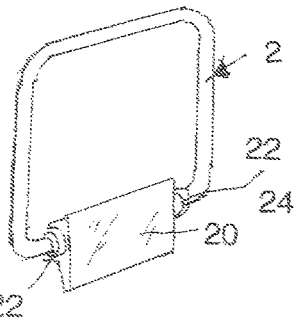
FIG. 7
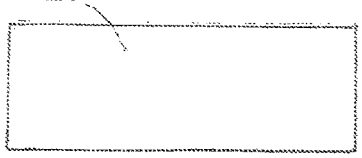
FIG. 8
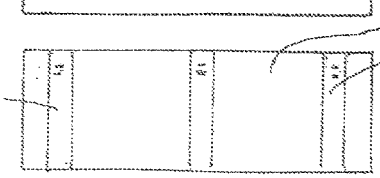
FIG. 9
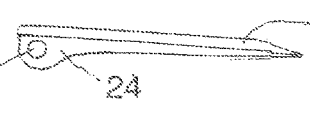
FIG. 10

FIG. 11
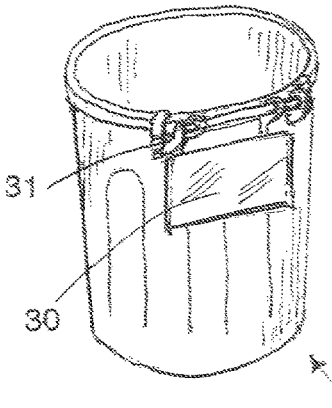
FIG. 12
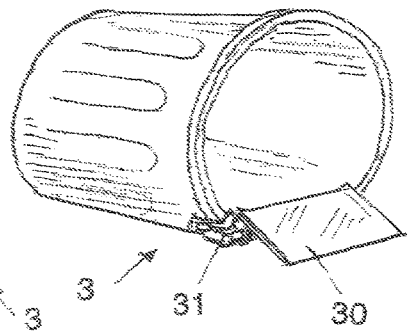
FIG. 13
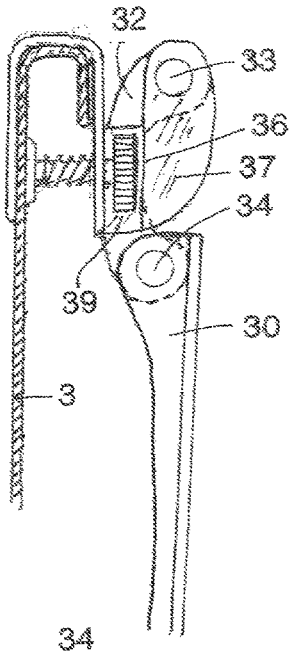
FIG. 14
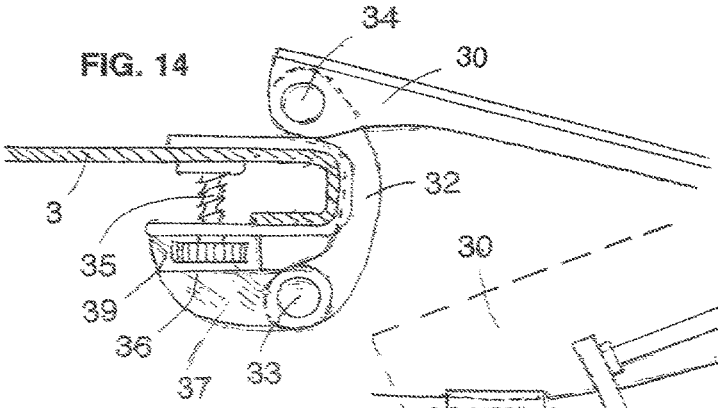
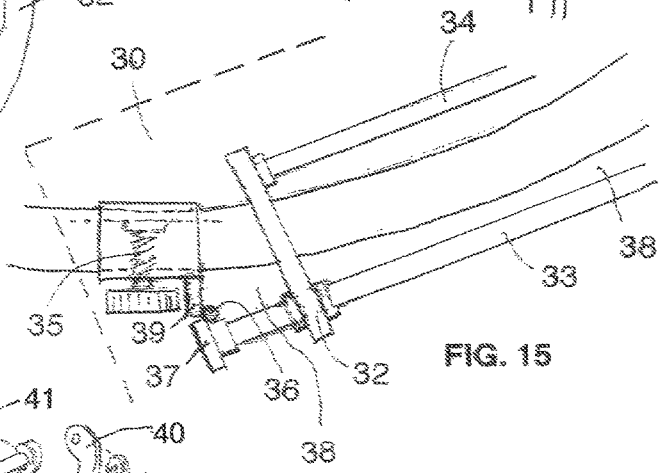
FIG. 15
FIG. 16
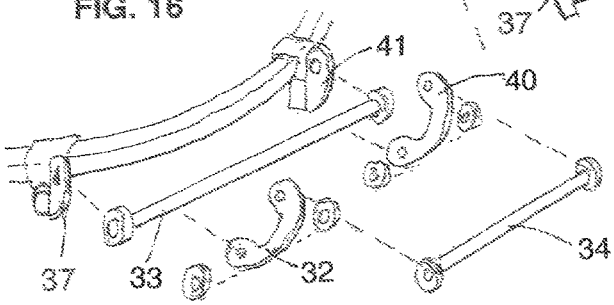

PIVOTAL THRESHOLD AND ATTACHMENT TO REFUSE CONTAINER

CROSS REFERENCE TO RELATED CASES

This application claims priority benefits of U.S. Provisional Application No. 61/960,998 filed on Oct. 3, 2013.

BACKGROUND OF THE INVENTION

Presently, refuse, trash, waste, garbage or debris receptacles usually stand vertical on their closed bottom with an open top side and a possible lid. In order to place debris from the floor into a vertical standing receptacle, one must first locate and retrieve a collecting pan and a broom or rake, sweep the debris into the dust pan, lift the loaded pan and dump the pan up and over the open top edge of the container. It usually requires many repetitive trips of this operation and often during this process some of the debris is accidentally dropped or spilled and must be retrieved again. Of course, this is a laborious and time consuming way of using a refuse container. Using one's hands is often an impossible and unhealthy way to solve the foregoing procedural problems.

A process of directly transferring debris from a floor or ground surface into a refuse container, eliminating the need to go through the before mentioned problems with a dust pan, would be very desirable, particularly when cleaning up volumes of materials like particles on a workshop floor or yard trimmings. Further, a ramp-like incline plane surface which would assist with directly sweeping refuse into a container laid over on one side, on the floor, would be more desirable. Finally, a refuse container with a permanently attached pivotal ramp-like threshold which is instantly available yet conveniently and unobtrusively stored on the container, is most desirable.

INFORMATION DISCLOSURE STATEMENT

The following list of inventions were found to be of interest:

Mackesy U.S. Pat. No. 8,490,240 July 2013
Miller U.S. Pat. No. 8,152,019 April 2012
Hudson U.S. Pat. No. 6,877,182 April 2012
McCoy et al. U.S. Pat. No. 8,291,543 October 2012
Simonson U.S. Pat. No. 7,131,552 November 2006
Mensch U.S. Pat. No. 6,915,921 July 2005
Lichtenwainer U.S. Pat. No. 6,318,588 November 2001
Anderson U.S. Pat. No. 6,155,522 December 2000
DeMars U.S. Pat. No. 5,611,450 March 1997
Jensen U.S. Pat. No. 4,802,258 February 1989
Rico U.S. Pat. No. 4,550,440 October 1985
Cross U.S. Pat. No. 4,312,531 January 1982
Thomas et al #D6684177 October 2012
Polkinghorn et al U.S. Pat. No. 7,770,576 14/2008
Springs, II. Wilson U.S. Pat. No. 6,974,167 December 2005
Snyder, James A. U.S. Pat. No. 5,511,807 April 1996
Hodgdon et al U.S. Pat. No. 5,222,536 June 1993
Bulkens, C. U.S. Pat. No. 4,907,710 March 1990

SUMMARY OF THE INVENTION

What is new in the present invention is a pivotal ramp threshold attached to or part of a mount on a solid refuse container, which is laid over on one side and the threshold can be pivoted to be stored in a hanging position on the exterior wall of the container when it is standing vertically and used conventionally. The present invention comprises a configuration of material which creates a reinforced rectangular flat wedge shaped inclined ramp surface, with a thin loading edge, and a thick edge containing a pivotal configuration and possibly raised sloping side edges to channel refuse into the container, made pivotal by a protuberance or perforation of the ramp's axis extending into and rotatable in a perforation or protuberance of a refuse container or this threshold can also be made pivotal by having a ring like structure or channel that pivots around an axle. Of course, this threshold can be made pivotal by any means common to the art. This pivotal threshold can be removably or permanently attached to the straight rolled-edge rim or wall of the open end of a refuse container, or to an axis or axle that is attached to the curved edge rim or wall of the open end of a refuse container. In the permanently attached version of the present invention, it is assumed that changes will need to be made to the construction of the refuse container, such as reinforcing areas and removing rim edges or adding apertures or protuberances to provide a pivotal axis.

The primary object of the present invention is to provide a convenient pivotal ramp threshold over which to sweep debris on a floor or ground surface into the open end of a solid refuse container that is laid over on one side on the surface.

Another object of this invention is to provide a pivotal threshold attached to a refuse container that can pivot out of interference with depositing refuse into the container standing at a vertical position, Another object of this invention is to provide a refuse container with a pivotal threshold that can be conveniently and unobtrusively stored on the outside of the container.

Another object of this invention is to provide a pivotal threshold for a refuse container which when stored on the container, will not interfere with standard operations like placing a lid on the container, rolling the open end of a liner bag over the open end of the container or laying an object over the open top on the container.

Another object of this invention is to provide a refuse container-dust-pan or—with a trash collecting threshold which is conveniently found and instantly available when needed.

One more object of this invention is to provide a pivotal threshold attached to the straight rolled-over edge rim of a rectangular refuse container.

Still another object of this invention is to provide a pivotal ramp threshold that can be attached to the curved open top rim or wall of a refuse container by means of a separate attachment bracket mechanism which provides an axis.

One more object of the invention is to provide a refuse container, with a pivotal threshold, that can be stacked.

These and other objects or advantages of the present invention will become fully apparent from the following description, when taken in connection with the accompanying drawings.

BRIEF DESCRIPTION OF THE DRAWINGS

FIG. 1—is a perspective view of the present invention in a stored position as applied to a rectangular refuse container standing vertically.

FIG. 2—is a perspective view of the present invention in a ramp threshold operating position as applied to a rectangular refuse container laid over on one side.

FIG. 3—is a cross section of the rolled-over top reinforced edge of the container in FIG. 1 where the top edge meets and receives the pivotal axle of the ramp threshold.

FIG. 4—is a partial perspective view illustrating where and how the ramp threshold is attached to the rectangular refuse container.

FIG. 5—is a cross section illustrating how the present invention rotates from the ramp threshold position to the stored position.

FIG. 6—is a top view of the ramp threshold in FIG. 9 and FIG. 10.

FIG. 7—is a view of the bottom of the threshold in FIG. 9 and FIG. 10.

FIG. 8—is a side view of the short side of FIG. 7.

FIG. 9—is a perspective view of the present invention as attached in a stored position to a cylindrical shaped refuse container standing vertically.

FIG. 10—is a perspective view of the present invention in a ramp threshold operating position as applied to a cylindrical refuse container laid over on one side.

FIG. 11—is a partial side view of the present invention's separate attachment bracket mechanism to a vertically standing cylindrical or rectangular refuse container's top rolled edge cross section, with the threshold in the stored position.

FIG. 12—is a partial side view of the present invention's separate attachment bracket mechanism to a cylindrical or rectangular refuse container's top rolled cross section, while the threshold has been rotated to a ramp threshold position and the container is lying on one side.

FIG. 13—is a partial top view of the present invention's separate attachment bracket mechanism attached to a cylindrical container's rolled top rim and wall.

FIG. 14—is an exploded perspective view of the present invention as applied to attaching the pivotal threshold separate attachment bracket mechanism to a curved refuse container's top rim and wall.

DETAILED DESCRIPTION

This invention provides a pivotal threshold ramp, with possibly raised sloping side edges, which is attached to a rectangular refuse container or the straight rim edge or wall of a refuse container 1 in FIG. 1, or a cylindrical refuse container 3, see FIG. 9. In the straight edge or rectangular shaped refuse container application, the threshold ramp 4 is pivotal from the stored position in FIG. 1 to the ramp operating position in FIG. 2. Referring to FIG. 4, this pivot action is within the enforced top rolled rim 5 of the container 1. FIG. 3 illustrates a suggested pivotal attachment of the threshold where a solid section 6 is molded or inserted in both open ends of the rolled rim of container 1 and the perforations 7 receives the pivotal protuberances 8 of FIG. 4. Of course, the threshold 4 may be made pivotal by any means in the art. Also, FIG. 3 shows a reinforced section 9 of the container wall 10 where there is an absence of part of the rolled edge, see FIG. 4, of the rectangular container. FIG. 5 illustrates the 180 degree rotation of the invented threshold from the threshold ramp position 11 to the threshold stored position 12 by the path of the arch 13.

In the cylindrical or straight edge refuse container application of the present invention, the pivotal ramp threshold 30 pivots from the stored position in FIG. 9 to the threshold ramp position in FIG. 10, on a separate attachment bracket mechanism 31. The threshold 30 is configured like in FIG. 6, land 8. FIG. 6, shows the top surface 21 of the ramp threshold 30, as FIG. 7 illustrates the bottom side 23 of the ramp threshold 30 with its struts 24. As shown in FIG. 8, there is a perforated hole or channel 25 on each strut 24 to rotate around axle 34 of the attachment bracket mechanism 31. FIG. 11 shows the axle link 32 of the attachment bracket mechanism 31 in FIG. 9 and the pivotal threshold 30 in the stored position on a vertically standing refuse container wall 3 cross section.

Two linkages of FIG. 14, one of which is 32 as shown in FIGS. 13 and 14, carries one axle 34 whereon the threshold 30 is pivotally mounted while they rotate on the other axle 33 from the vertical storage position in FIG. 11 to the ramp position in FIG. 14 12 with the refuse container 3 laid on one side. The ramp threshold 30 would be pivotally attached to axle 34. In another alternative figuration, linkages 32 and 40, seen in FIG. 14, could be directly pivotally attached to panels 37 and 41 respectively, eliminating axle 33. Also, the same linkages's 32 and 40 opposite ends, that hold axle 34, could be directly pivotally attached to the pivotal threshold, eliminating axle 34. The ramp threshold could be also directly pivotally attached to panels 37 and 41 eliminating both links and both axles.

With reference to FIGS. 11, 12 and 13, a screw vise clamp 35 attaches the mechanism to the wall and top rolled rim of a refuse container 3. Of course, this clamp can be a toggle or any means known in the art of attaching the present invention to a refuse container, or the attaching means can be molded as part of the refuse container.

Referring to FIG. 13, it will be noticed that there is a hinged 36 panel 37 that supports axle 33, or in the alternative figuration, linkage 32. This is to adapt the clamp 35 to the curve of the cylindrical container's rim and adjust to different rim diameters. The hinged panel 37 as shown in FIGS. 11 and 12, has its hinge in an open flat position suitable for attaching to a straight linear rim or wall of a refuse container, whereas, in FIG. 13 the hinged panel 37 is in a partially closed angled position suitable for a curved rim or wall.

As seen in FIGS. 11, 12 and 13, panel 37 is extended out and then upward from the curved rolled top edge of the refuse container by the hinge's other stationary side 39. The top of this stationary panel 39 is lower than the top of panel 37 and axle 33 in order to provide a space 38, in FIG. 13, to make it possible for a container lid or a liner bag to wrap over and around the curved upper rolled edge of the refuse container when the threshold is in the stored position FIG. 13 indicates by broken lines, where a corner of the pivotal threshold 30 could be positioned in the ramp position, therefore imagining the position of the total pivotal threshold. In reference to the exploded perspective view in FIG. 14, the pivotal threshold is missing but the attachment bracket mechanism parts are there.

The present embodiment described herein is to be considered in all respects as illustrative and not restrictive. While several embodiments of the invention have been shown and described, it will be apparent that other adaptions and modifications of this invention can be made by those skilled in the art without exceeding the essence and scope of the invention as defined in the following claims.

What is claimed is:

1. A refuse container system comprising:

a rigid walled refuse container having a closed bottom, an open end with a rim and, a rigid wall extending from the closed bottom to the open end;

a connection bracket for attaching an inclined shaped pivotal ramp threshold to the rim;

the connection bracket comprising:

a vice clamp directly attached to the rim of the refuse container;

a hinged panel directly attached to the vice clamp, wherein the hinged panel is movable from an open position to a closed position to adjust for the rim diameter or straight section of the rim;

a first elongated cylindrical axle having a first length, wherein the first axle is directly attached to the hinged panel at one end of the first length, and the first axle is directly attached to a second panel at the opposite end of the first length;

a first U shaped axle holding arm, where the first axle holding arm is directly attached to the first axle with a connection means located at the bottom of the first axle holding arm, wherein the first axle holding arm extends outward from the first axle, and wherein the first axle holding arm is rotatable about the first axle;

a second U shaped axle holding arm, where the second axle holding arm is directly attached to the first axle with a connection means located at the bottom of the second axle holding arm, wherein the second axle holding arm extends outward and upward from the refuse container wall, and wherein the second axle holding arm is rotatable about the first axle;

a second elongated cylindrical axle having a second length, wherein the second axle is directly attached to the top of the first axle holding arm at one end of the second length, and the second axle is directly attached to the top of the second axle holding arm at the opposite end of the second length;

the refuse container system further comprising:

an inclined shaped pivotal ramp threshold having a thin end and a thicker opposite end, where the thick end is directly attached to second axle, wherein the ramp threshold is rotatable about the second axle;

wherein the threshold extends along the rigid wall when the pivotal ramp threshold is in a first position, and wherein the axle holding arms rest on a top surface of the rim, and the pivotal ramp threshold extends past the rim and away from the rigid wall when the inclined ramp threshold is in a second deployed position.

2. A refuse container and pivotal ramp threshold attachment system comprising:

a refuse container having a closed bottom, an open end with a straight section of rim and, a rigid wall extending from the closed bottom to the open end;

an inclined shaped pivotal ramp threshold having a thin end and a thicker opposite end;

the rigid walled refuse container comprising:

a modified straight sectional length of rim partially removed, molded, recessed, concave, grooved and made suitable for an equal length and girth cylindrical rod to horizontally pivot within;

a receptacle perforation hole horizontally placed in each solid opposite end of the container rim adjacent to the ends of the modified straight rim section;

a smaller width diagonal slot providing access to one of the rim perforation holes;

a reinforced and strengthened rigid wall under the modified straight section of container rim;

the pivotal ramp threshold comprising;

the thicker end having a more than half round pivoting cylindrical edge;

a cylindrical protuberance on each opposite end of the length of the thicker end of the ramp threshold;

wherein the cylindrical protuberance on one end of the thick cylindrical end of the ramp threshold is inserted into the perforation hole at one end of the solid container rim, and the cylindrical protuberance at the opposite end of the thick end of the ramp threshold is snapped into the perforation hole via the access slot at the opposite end of the solid container rim, the ramp threshold is pivotally attached to the refuse container;

wherein the ramp threshold extends under the container rim and along the rigid wall when the pivotal ramp threshold is in a stored first position, and wherein the pivotal ramp threshold is flush with the straight modified section of container rim and away from the rigid wall when the ramp threshold is in a deployed operating second position.

* * * * *